United States Patent [19]

Viner

[11] Patent Number: 4,598,499

[45] Date of Patent: Jul. 8, 1986

[54] SLIDING DOOR EDGE SUPPORT

[75] Inventor: George C. Viner, Chippenham, United Kingdom

[73] Assignee: Westinghouse Brake & Signal, Wiltshire, England

[21] Appl. No.: 584,891

[22] Filed: Feb. 29, 1984

[30] Foreign Application Priority Data

Mar. 25, 1983 [GB] United Kingdom ..... 8308301

[51] Int. Cl.[4] ..... E05D 13/00

[52] U.S. Cl. ..... 49/411

[58] Field of Search ..... 49/304, 409, 410, 411; 16/90

[56] References Cited

U.S. PATENT DOCUMENTS

| | | | |
|---|---|---|---|
| 56,046 | 7/1866 | Hawkins | 49/304 |
| 704,395 | 7/1902 | Sowden | 49/304 |
| 725,052 | 4/1903 | Dillon | 49/304 |
| 835,069 | 11/1906 | Johnston | 49/304 |
| 1,486,525 | 3/1924 | Jones | 49/410 X |
| 3,756,302 | 9/1973 | Sivin | 16/90 X |
| 4,090,265 | 5/1978 | Baus | 49/410 X |

FOREIGN PATENT DOCUMENTS

| | | | |
|---|---|---|---|
| 1509280 | 5/1969 | Fed. Rep. of Germany | 49/304 |
| 2319399 | 10/1974 | Fed. Rep. of Germany | 49/304 |
| 588007 | 5/1977 | Switzerland | 49/410 |

*Primary Examiner*—William E. Lyddane
*Assistant Examiner*—James R. Brittain
*Attorney, Agent, or Firm*—Larson and Taylor

[57] ABSTRACT

A sliding door arrangement which provides lateral support for the free edge or bottom nose corner of a door comprises a retractable member which is raised through an aperture in the floor or doorway threshold to interlockingly engage said edge of the door in the closed position. When the door is opened the engaging member is automatically retracted to lie flush with the floor surface. The member is carried by a rocking lever under the floor which is linked to another counterbalanced lever nearer the door frame which also has a raised protrusion which is abutted by a cam on the door as it reaches the closed position.

5 Claims, 6 Drawing Figures

SLIDING DOOR EDGE SUPPORT

This invention relates to sliding doors and is particularly concerned with the problem of supporting or retaining the bottom nose corners or free edges of sliding doors when in the closed positions.

Sliding doors, whether used singly or in abutting pairs are usually supported by suspension rollers and track at the top of the doors. Where it is desirable to keep the floor below the door entirely free of any raised or depressed track or guide the lower edges of the door are generally left free within the clear doorway width although sometimes interlocking or engaging nose seals are provided on the bottom nose corners or free edges of the doors.

Such doors may be subjected to forces normal to the line of the door such as that created by winds or in the case of doors used on the edges of underground railway platforms, the bow wave pressure of an approaching train or the suction of a receding train.

When such sliding doors are used as the entrance doors to large department stores winds of gale-force may apply a considerable force normal to the line of the door which can cause the doors to break or to open inadvertently.

Although positive support of the bottom edges by means of a protruding blade or roller guide is one solution to the problem and channel guides in the thresholds are another solution both of these solutions have disadvantages in that they provide in one case a projection likely to trip people up and in the other case a space in which dirt and rubbish may collect and cause the door to jam during the closing movement. An object of the invention is to provide a sliding door edge retainer for the free edges or bottom nose corners of sliding doors which will not interfere with the normal floor or threshold below the door and will not present any undesirable projection or recess.

In accordance with the invention there is provided a sliding door arrangement in which a retaining member is mounted flush with a floor or threshold below the free edge of a closed door, and said member forms part of a mechanism operable, by movement of the door itself into the closed position, to raise the retaining member into interlocking engagement with said free edge of the door.

Preferably the mechanism for raising the retaining member into interlocking engagement is located below the floor or door threshold.

For example the retaining member is carried at one end of a rocking lever located below the threshold and may be raised to protrude through an aperture in the threshold for interlocking engagement with a closed door or lowered to lie flush with the threshold when the doors are open.

The retaining member is operated by a mechanism consisting of a rocking lever carrying the retainer connected by a link to a second counter-balanced rocking lever carrying a projection member which normally projects above the floor level into or adjacent the path of the door, the door carrying an operating block or cam to engage the projecting member as the door closes thus causing the system of levers and the link to operate so as to raise the retaining member into a position where it engages the free edge of a door, or the free edges of a pair of mating doors, so as to retain those edges against movements caused by forces at right angles to the path of the door.

In one particular arrangement the whole mechanism is mounted on a threshold plate which may be arranged to be fitted with the floor below the door. The threshold plate carries at one end a rocking lever which is counter-balanced and carries the projecting member and at the other end a second rocking lever which carries the retaining member. The two rocking levers are connected by a link which runs below the threshold plate. The operating block or cam is chamfered and is carried by the outer edge of the door i.e. the edge remote from the free edge or nose portion.

There may be two such retaining mechanisms provided one for each of a pair of abutting sliding doors or each door may be provided with its own retaining mechanism.

Because the threshold of the door opening remains entirely clear of projections or protrusions as long as the doors are open, the mechanism does not inconvenience users of the door. The mechanism may be applied to any sliding door or pair of sliding doors used in any situation such as entrance doors to a bank or department store or airport, doors arranged along the edge of a platform of an underground railway system, sliding patio doors, sliding doors provided in screens round a swimming pool or similar structure, etc.

In the accompanying drawings by way of illustration, the invention is shown as applied to a pair of sliding doors which form part of the safety barrier or screen at the edge of a station platform, for instance in an underground system.

In FIG. 1 is shown a general elevation of such a station platform with a system of screens and sliding doors;

FIGS. *2a* and *2b* together illustrate the edge retainer mechanism of this invention embodied in a threshold plate may be used with the doors shown in FIG. 1;

Figure 1:
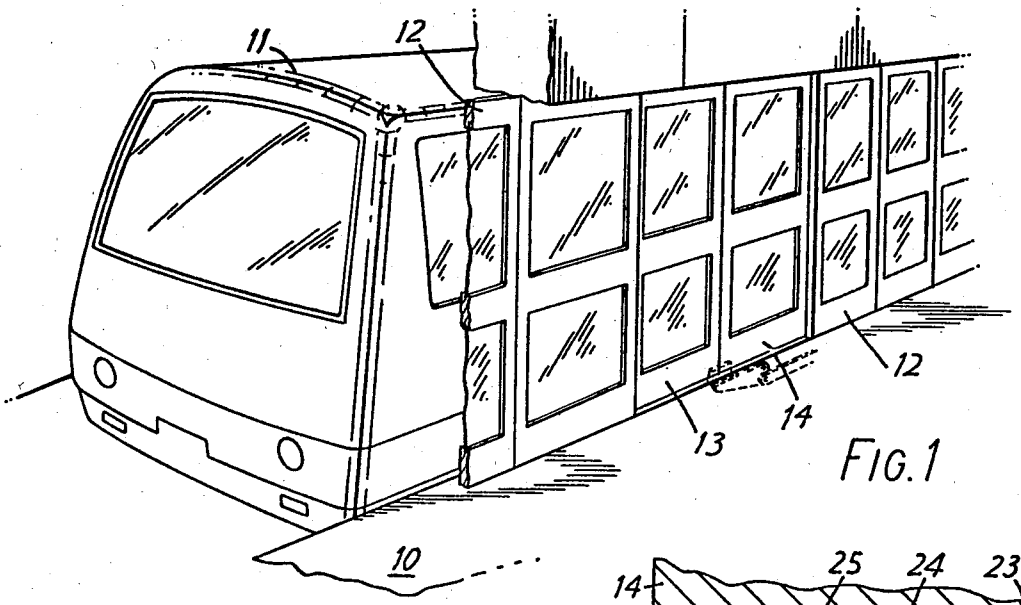
Figure 3:
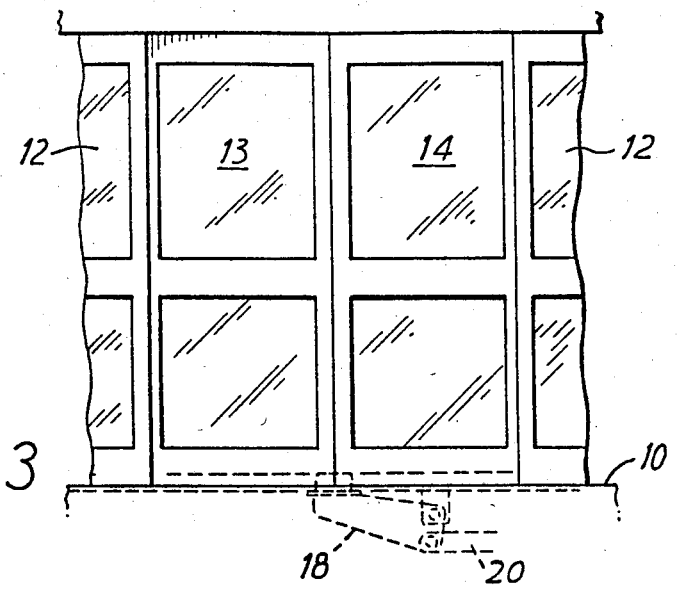
FIG. 3 shows diagrammatically the way in which the mechanism may be applied to a pair of doors using a single mechanism.
Figure 4:
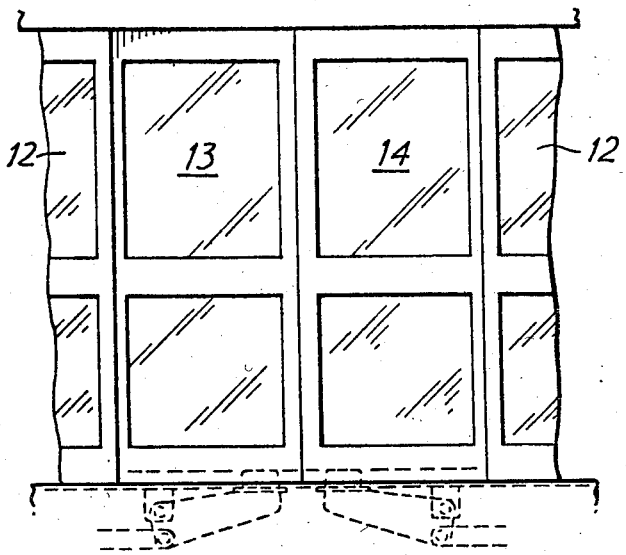
FIG. 4 shows the way in which a pair of doors may be retained by using two sets of the mechanism one for each door.

In the drawings, FIGS. 1, 3 and 4 the retaining member and its operating mechanism are shown in an exaggerated scale relative to the doors in order that the construction of the embodiment may be more readily appreciated.

In FIG. 1 is shown the platform 10 of an underground railway station. The train 11 lies behind a series of partitions 12 and doors 13, 14 arranged along the edge of the platform so as to separate the passengers from the track.

Pairs of sliding doors such as 13 and 14, are located at intervals spaced apart along a platform edge corresponding to the positions of train doors and, when open, provide an aperture slightly larger than the train doors. The arrangement is such that the doors 13, 14 will only open when the train is properly positioned in relation to the doors so as to provide registry between the train doors and the platform doors.

The mechanism according to the invention which is shown in detail in FIG. 2 comprises a threshold plate 15 which may be let into the platform floor so as to lie flush with the platform below the sliding doors 13, 14 which are suspended at their top ends by conventional track and roller systems, not illustrated in detail.

The threshold plate 15 carries two brackets 16 and 17. Pivoted to bracket 16 is a rocking lever 18 formed at its left-hand end with a protruding retainer member 19 which, when the doors are in their open position is arranged so that its upper surface 19*a* lies flush with the upper surface 15*a* of the threshold plate. The aperture in the threshold plate is such as to provide minimal clearance for the retainer member 19 so that there is no protrusion and very little space for rubbish to collect around the retaining member.

Lever 18 is connected by a link 20 to a second counter-balanced rocking lever 21 pivoted at 17*a* to the bracket 17. The counter-balanced lever 21 has a counter-balancing weight 22 at one end and a projection 23 which extends through an aperture 32 in threshold plate 15 so as to lie above the threshold plate when the doors are in their open position.

The bottom edges of the doors are provided with an internal groove 24 and run on a fixed guide 25. The projection 23 enters this groove 24.

At the right hand side of the right hand door there is an operating block 26 with a chamfered face 27 adapted to engage the projection 23 as the door moves from right to left. Thus as the door reaches its closed position the operating block will have engaged the projection 23 thus causing lever 21 to rock about pivot point 17*a* which in turn moves the link 20 so as to rock lever 18 about its pivot point 16*a*. This causes the retaining member 19 to move upwardly so as to protrude above the upper surface 15*a* of the threshold plate and to enter the groove 24 in the lower edge of the door near the nose or free edge of the door. Thus in its closed position the door is prevented from moving as a result of forces applied at right angles to the sliding direction of the doors. As shown diagrammatically in FIG. 3 there may be a single mechanism which retains both doors by a single retainer member or as shown in FIG. 4 there may be a pair of mechanisms one for each of the two sliding doors. Clearly if there is only one sliding door in an installation then only a single retaining mechanism is required.

Figure 5:
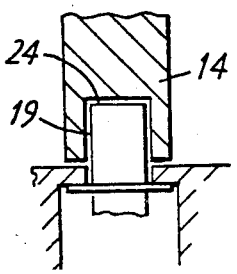
FIG. 5 shows a section through the door with the retainer block in position.

FIG. 5 shows a section through the door with the retaining member 19 engaged in the groove 24.

Figure 6:
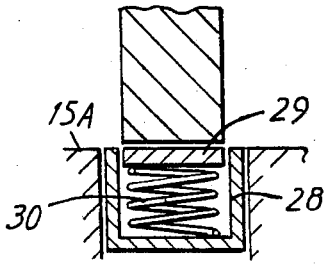
FIG. 6 shown an alternative arrangement for the retainer block.

FIG. 6 shows an alternative arrangement of retainer mechanism which is carried by the pivoted lever 18. In this case the retainer mechanism consists of a retainer member 28 which is U-shaped so as to engage around the faces of the door rather than within a groove in the bottom edge of the door. There may be a flush plate 29 spring pressed by a spring 30 so as to maintain a flush surface of the retainer member in line with the threshold plate upper surface 15*a*.

Figure 2:
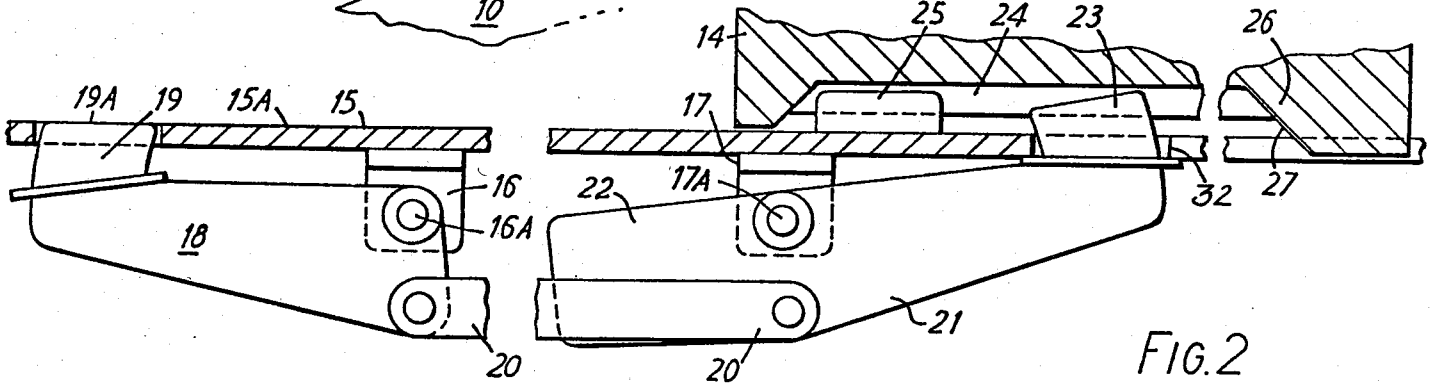

The link 20 shown in FIG. 2 may be in the form of a rigid rod which may be adjustable for length to suit different installations.

As the door starts to open the operating block or cam 26 moves to the right as seen in FIG. 2 thus allowing the projection 23 to move upwardly as lever 21 pivots about pivot point 17*a* under the influence of the counter-balance weight 22. This will cause the mechanism to withdraw the retaining member 19 to its normal disengaged position with its upper surface 19*a* flush with the upper surface 15*a* of the threshold plate.

A further operating block (not shown) may be provided adjacent the free edge or nose corner of the door 14 to ensure positive retraction of the lever as the door opens.

The threshold plate may be an extruded plate with a ribbed surface to avoid slipping or it may be a casting. It may be installed as a self-contained unit and since it has very few moving parts it can be maintenance free over extended periods. Of course it does not require an external power source and thus there are no electrical connections or wires running under the threshold plate which could cause problems.

I claim:

1. A sliding door arrangement comprising a sliding door mounted in a doorway for sliding movement between an open and a closed position, the doorway having a threshold in which is formed an aperture in a position below a free edge of the door when the door is in the closed position thereof, a retaining member mounted below the threshold and in a position where the retaining member can be raised and lowered through said aperture, the retaining member, when raised, engaging said free edge of the door and, when lowered, lying flush with the threshold, means for raising and lowering said retaining member, said raising and lowering means comprising a first rocking lever pivotally mounted below the threshold which carries the retaining member, a second rocking lever pivotally mounted in a position to be engaged by and moved by the door as the door reaches the closed position thereof, and a rigid link having first and second ends, wherein said first end of said rigid link is pivotally connected to the first rocking lever and said second end of said rigid link is pivotally connected to the second rocking lever, whereby, as the door reaches the closed position thereof, the door engages and moves the second lever and the resultant movement of said second lever is transmitted through the rigid link to the first lever which raises the retaining member into engagement with the free edge of the door thereby retaining the free end of the door in place.

2. A sliding door arrangement as claimed in claim 1 wherein the second rocking lever includes means for providing counterbalancing thereof towards a position in which the retaining member is lowered.

3. A sliding door arrangement as claimed in claim 2 wherein the second rocking lever is mounted below the threshold, and said threshold is formed with an aperture in a position such that a member carried by the second projects above the threshold level for engaging the door.

4. A sliding door arrangement as claimed in claim 3 wherein the door carries a cam member which abuts the projecting member carried by the second lever.

5. A sliding door arrangement as claimed in claim 4 wherein the cam member has a chamfered face which abuts the projecting member carried by the second lever.

* * * * *